US006001008A

United States Patent [19]

Fujimori et al.

[11] Patent Number: 6,001,008

[45] Date of Patent: Dec. 14, 1999

[54] ABRASIVE DRESSER FOR POLISHING DISC OF CHEMICAL-MECHANICAL POLISHER

[75] Inventors: Keiichi Fujimori; Junji Matsuo, both of Tokyo, Japan

[73] Assignee: Fujimori Technology Laboratory Inc., Japan

[21] Appl. No.: 09/293,459

[22] Filed: Apr. 15, 1999

[30] Foreign Application Priority Data

Apr. 22, 1998 [JP] Japan ..... 10-112127

[51] Int. Cl.[6] ..... B24B 21/18; B24B 33/00; B24B 47/26; B24B 55/00

[52] U.S. Cl. ..... 451/443; 451/444; 451/548

[58] Field of Search ..... 451/443, 444, 451/41, 70, 56, 58, 287, 288, 289, 290, 540, 548, 550

[56] References Cited

U.S. PATENT DOCUMENTS

| | | | |
|---|---|---|---|
| 2,137,200 | 11/1938 | Boyer | 451/548 |
| 4,010,583 | 3/1977 | Highberg | 451/56 |
| 5,454,752 | 10/1995 | Sexton et al. | 451/548 |
| 5,567,503 | 10/1996 | Sexton et al. | 451/548 |
| 5,605,499 | 2/1997 | Sugiyama et al. | 451/443 |
| 5,626,509 | 5/1997 | Hayashi | 451/56 |

*Primary Examiner*—Derris Holt Banks
*Attorney, Agent, or Firm*—Laubscher & Laubscher

[57] ABSTRACT

With an abrasive dresser for a polishing disc of a chemical-mechanical polisher for abrading a flat rotatable polishing disc of a chemical-mechanical polisher which supplies a chemical polishing agent to the surface of the polishing disc to polish the surface of an article on top of the polishing disc, a sectional shape of an abrasive surface being a peripheral portion of a flat disc shaped base member which protrudes upwards over a predetermined width with an abrasive grit distributed substantially uniformly over and affixed to the surface thereof, is formed as a convex circular arc curved surface. In this way, the portion of contact with the polishing disc of the chemical-mechanical polisher becomes surface contact, thereby enabling a reduction in wear during use and an increase in life, together with an increase in the efficiency of abrading the polishing disc.

4 Claims, 6 Drawing Sheets

ABRASIVE DRESSER FOR POLISHING DISC OF CHEMICAL-MECHANICAL POLISHER

BACKGROUND OF THE INVENTION

1. Field of the Invention

The present invention relates to an abrasive dresser for abrading a flat rotatable polishing disc of a chemical-mechanical polisher which supplies a chemical polishing agent to the surface of the polishing disc to polish the surface of an article such as a wafer on top of the polishing disc. In particular the invention relates to an abrasive dresser for a polishing disc of a chemical-mechanical polisher, designed so that the portion of contact with the polishing disc of the chemical-mechanical polisher becomes surface contact, thereby enabling a reduction in wear during use and an increase in life, together with an increase in the efficiency of abrading the polishing disc.

2. Description of the Related Art

Recently, with the manufacture of semiconductor products such as integrated circuits, circuit integration has increased in response to the requirement for increased integrated circuit capacity, and with this there has been a thinning of the insulation film between circuit layers. To meet this requirement, a technique has been adopted for manufacturing integrated circuits including, as shown in FIG. 7, forming on a silicon substrate 1, wiring grooves 2 in conformity to a wiring pattern, and then under this condition, forming a metal layer 3 such as an aluminum layer over the whole surface of the silicon substrate 1. After this, a flat wiring pattern is formed by polishing away the metal layer 3 so that only the metal layer 3 inside the wiring grooves 2 remains. A plurality of the wiring patterns are multi-layered.

FIG. 8 is a cross-sectional view showing a polishing disc 4 of a chemical-mechanical polisher (referred to hereunder as a CMP) which is used, in the manufacture of the above-mentioned integrated circuit, at the time of polishing the metal layer 3 for the wiring, which is formed over the whole surface of the silicon substrate 1. As shown in FIG. 8, the polishing disc 4 is made by affixing a flat polishing pad 6 onto a flat disc base 5. A fine abrasive material is mixed with a chemical polishing agent such as an acid, and this is supplied to the surface of the polishing pad 6 of the polishing disc 4. Then by rotating the polishing disc 4, and contacting the metal layer 3 of the silicon substrate 1 which is retained on a retainer 7, against the surface of the polishing pad 6, the metal layer 3 is polished away by the chemical polishing agent and the abrasive material.

Since the polishing pad 6 of the polishing disc 4 is also worn at the time of polishing away the metal layer 3 so that the flatness of the polishing pad 6 cannot be maintained, an abrading apparatus for abrading the polishing pad 6 is incorporated into the CMP. The polishing pad 6 is thus abraded with an abrasive dresser of the abrading apparatus.

FIG. 9 is a cross-sectional view showing a conventional abrasive dresser 8. The abrasive dresser 8 comprises for example, an outer peripheral portion of a circular flat disc base member 9 protruding upwards with a predetermined width, and an abrasive surface 11 formed by substantially uniformly distributing and affixing an abrasive grit such as diamond grit to the surface of the upward protruding portion 10.

As shown in FIG. 10, the abrasive dresser 8 is retained by a retainer 12. By rotating the polishing disc 4 and contacting the abrasive surface 11 of the abrasive dresser 8 which is retained by the retainer 12, from above against the surface of the polishing pad 6, the surface of the polishing pad 6 of the polishing disc 4 is abraded. At this time, when an additional load is applied in the direction of the arrow P to the central portion of the retainer 12 so that the abrasive surface 11 of the abrasive dresser 8 pushes against the polishing pad 6 of the polishing disc 4 from above, then under the pressing force of the abrasive surface 11 the polishing pad 6 deforms to a slightly sunken shape due to its resilience. Then, as a result of the abrading of the polishing pad 6, the flatness of the surface of the polishing pad 6 is maintained, and cleaning of the pad surface is also effected.

With this conventional abrasive dresser 8 however, since as shown in FIG. 9 the sectional shape of the abrasive surface 11 is formed as a flat surface, then when as shown in FIG. 10 the abrasive surface 11 of the abrasive dresser 8 is pressed from above against the polishing pad 6 of the polishing disc 4, the polishing pad 6 is pressed by the overall surface of the abrasive surface 11 which is formed in a doughnut shape with a predetermined width at the outer peripheral portion of the base member 9. However due to this pressing, the deformation to a sunken shape of the polishing pad 6 becomes greatest at the outermost peripheral portion of the abrasive surface 11. Consequently, the contact pressure of the abrasive surface 11 on the polishing pad 6 becomes greatest at the outermost peripheral portion, effectively resulting in a linear contact condition due to the circle, that is the contour of the outermost peripheral portion.

Due to this, then only the abrasive grit distributed over and affixed to the outermost peripheral portion of the abrasive surface 11 is contacted strongly against the polishing pad 6 to give abrasion, and hence only this abrasive grit is rapidly worn. On the other hand, the abrasive grit distributed over and affixed to the inner peripheral portion of the abrasive surface 11 does not have sufficient contact pressure against the polishing pad 6, and hence this cannot effectively contribute to the abrasion of the polishing pad 6. Consequently, the resultant abrasive dresser 8 where the abrasive grit affixed to the outermost peripheral portion of the abrasive surface 11 is worn, cannot serve the purpose of abrading the polishing pad 6, and must be replaced with a new abrasive dresser 8. That is to say, the life of the abrasive dresser 8 is short. Furthermore, a single abrasive dresser 8 cannot abrade a large number of polishing pads 6 of the polishing disc 4, and hence the efficiency of abrading the polishing disc 4 is reduced.

SUMMARY OF THE INVENTION

It is an object of the present invention to address the above problems by providing an abrasive dresser for a polishing disc of a chemical-mechanical polisher, designed so that the portion of contact with the polishing disc becomes surface contact, thereby enabling a reduction in wear during use and an increase in life, together with an increase in the efficiency of abrading the polishing disc.

To achieve the above object, according to the present invention, there is provided an abrasive dresser for a polishing disc of a chemical-mechanical polisher, for abrading a flat rotatable polishing disc of a chemical-mechanical polisher which supplies a chemical polishing agent to the surface of the polishing disc to polish the surface of an article on top of the polishing disc, the abrasive dresser comprising an abrasive surface formed by substantially uniformly distributing and affixing an abrasive grit to the surface of an outer peripheral portion of a flat disc shaped base member, which protrudes upward over a predetermined width, wherein the sectional shape of the abrasive surface is formed as a convex circular arc curved surface.

With this construction, the portion of contact with the polishing disc of the chemical-mechanical polisher can effectively become surface contact. Moreover, rapid wear of only one portion of the abrasive surface during use of the abrasive dresser can be prevented, enabling an increase in the life of the abrasive dresser.

Moreover, the affixing of the abrasive grit to the abrasive surface may include affixing using metal electro-deposition. If this is done, then affixing of the abrasive grit can be easily and securely performed.

Furthermore, the affixing of the abrasive grit to the abrasive surface may include bonding with a bonding agent having a resistance to the chemical polishing agent. If this is done, then peeling off of the abrasive grit due to the chemical polishing agent can be prevented.

Furthermore, the abrasive grit may be made from diamond grit. In this case, since diamond grit is a hard material and is also resistant to the chemical polishing agent, this is ideal for abrading the polishing disc.

DETAILED DESCRIPTION OF A PREFERRED EMBODIMENT

Figure 1:
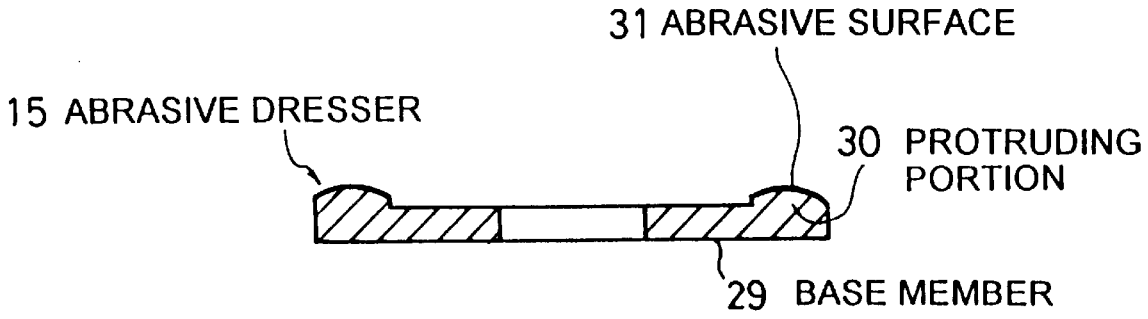
FIG. 1 is a cross-sectional view showing an abrasive dresser for a polishing disc of a chemical-mechanical polisher according to the present invention, being a sectional view on line A—A of FIG. 2.
Figure 2:
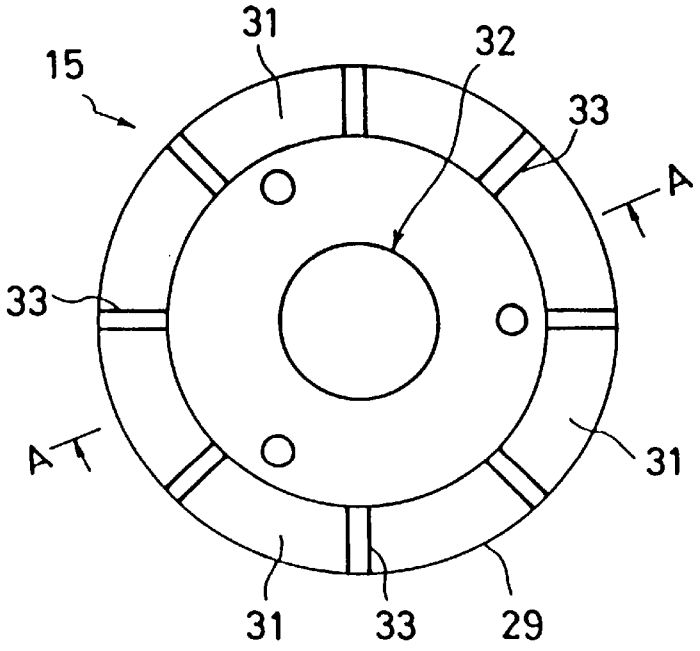
FIG. 2 is a plan view showing the abrasive dresser.

FIG. 1 is a cross-sectional view showing an abrasive dresser 15 for a polishing disc of a chemical-mechanical polisher according to the present invention, being a sectional view on line A—A of FIG. 2. FIG. 2 is a plan view showing the abrasive dresser 15. The abrasive dresser 15 is a device for abrading a flat rotatable polishing disc in a chemical-mechanical polisher (referred to hereunder as a CMP) which supplies a chemical polishing agent to the surface of the polishing disc to polish the surface of an article such as a wafer on top of the polishing disc.

Figure 5:
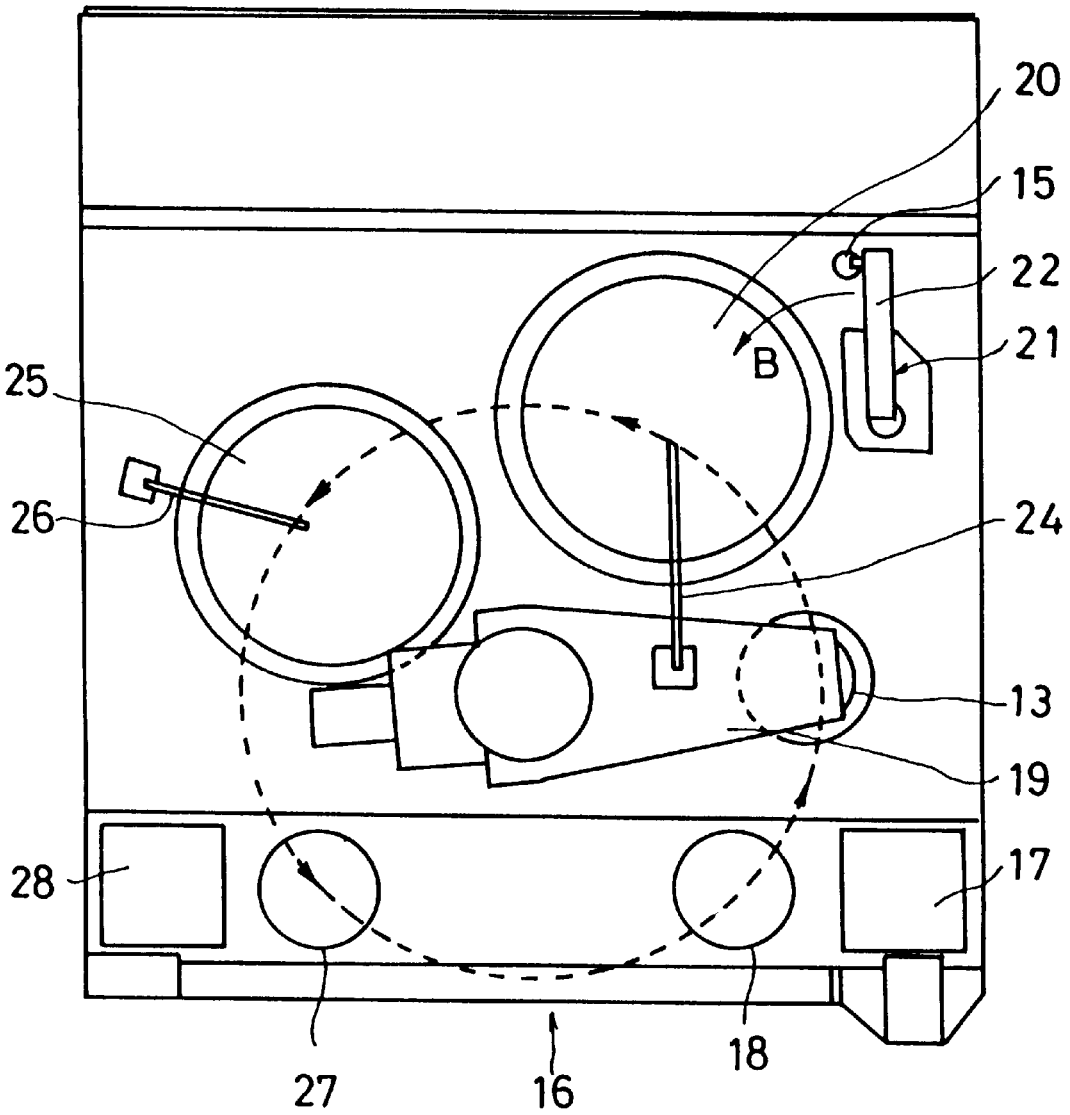
FIG. 5 is a plan view showing a chemical-mechanical polisher incorporating the abrasive dresser.
Figure 6:
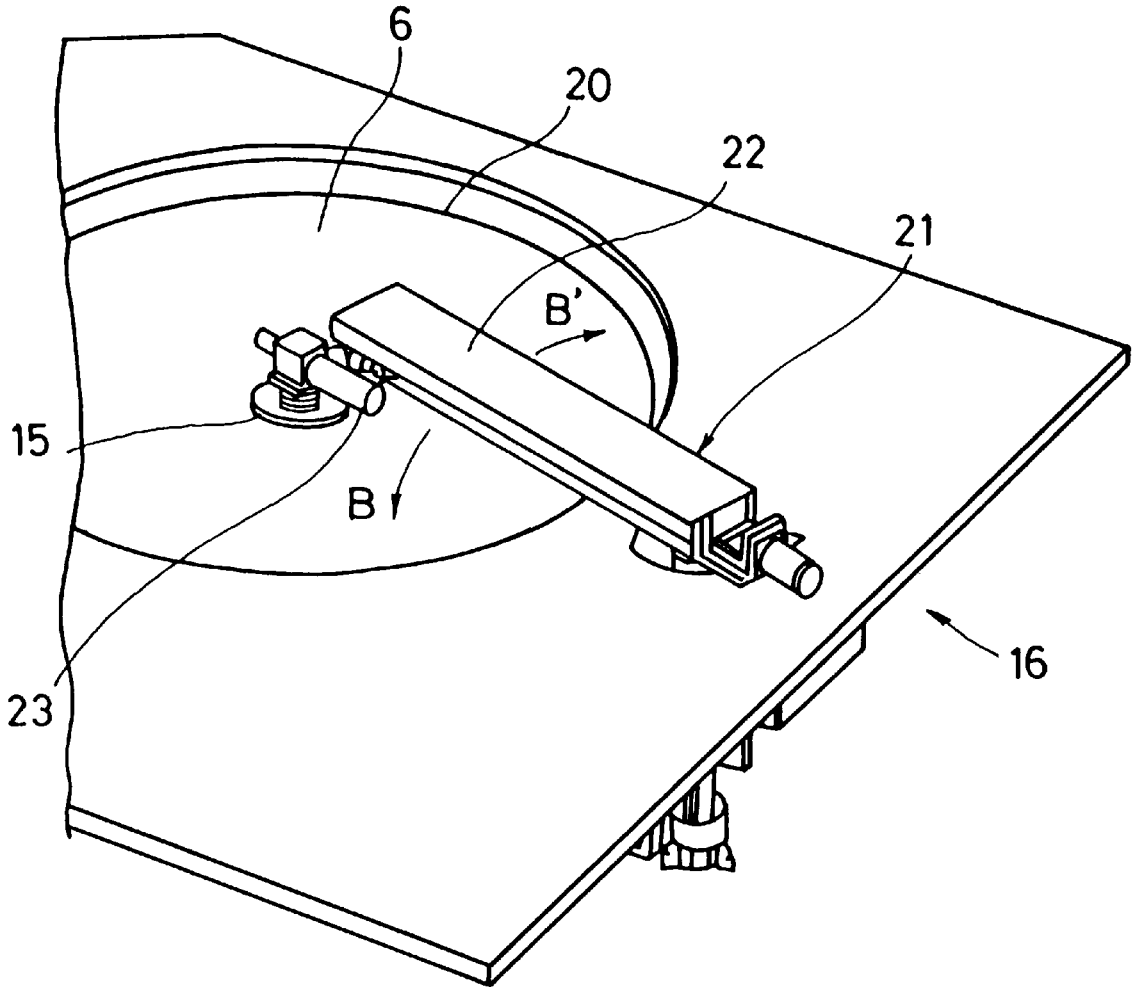
FIG. 6 is a perspective view showing the main parts of the chemical-mechanical polisher.
Figure 7:
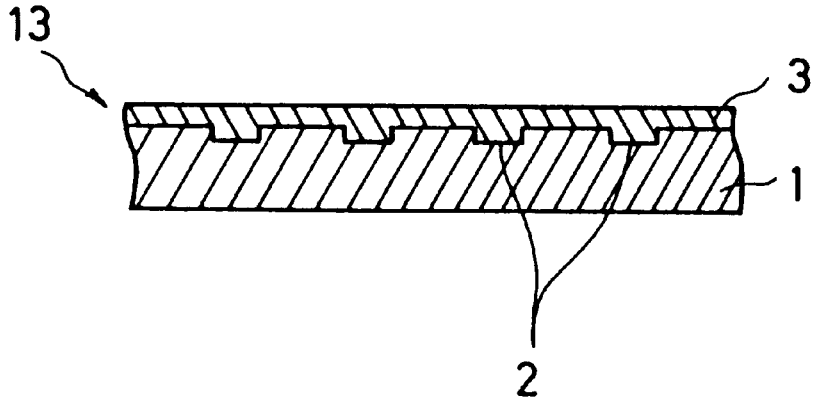
FIG. 7 is a sectional view showing a silicon substrate which is polished away by the chemical-mechanical polisher.

At first is a description of the basic outline of the CMP 16, with reference to FIG. 5 and FIG. 6. In FIG. 5, a loading station 17 is a place provided for mounting a wafer cassette (not shown in the figure). In the wafer cassette is housed an unprocessed wafer 13 with a metal layer 3 formed on a silicon substrate 1 as shown in FIG. 7. A clean station 18 is a place provided for delivering the wafer 13 to a carrier arm 19. The carrier arm 19 supports the wafer 13 which is attached by suction attachment or the like at the clean station 18, and rotates in the direction of the arrow in FIG. 5 to carry the wafer to respective locations to be described hereunder.

Figure 8:
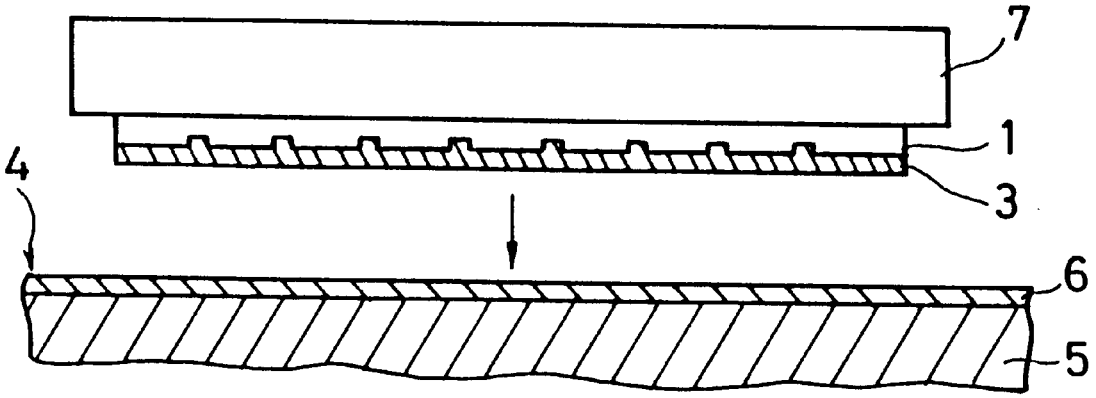
FIG. 8 is a sectional explanatory view showing a condition where the silicon substrate is being polished away by the chemical-mechanical polisher.
Figure 9:
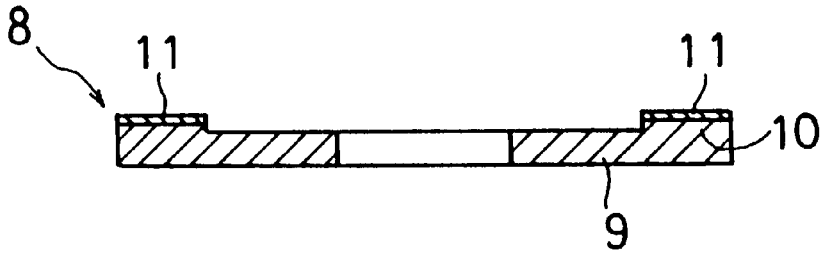
FIG.9 PRIOR ART
FIG. 9 is a cross-sectional view showing a conventional abrasive dresser.
Figure 10:
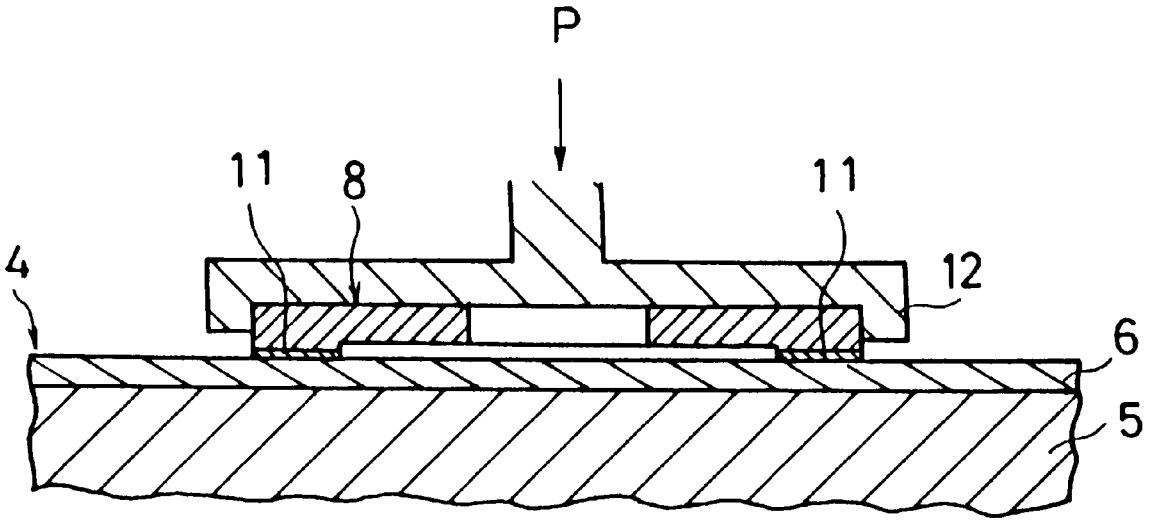
FIG.10 PRIOR ART
FIG. 10 is a sectional explanatory view illustrating a condition of use of the conventional abrasive dresser.

A primary platen 20 is a place for the actual polishing away of the metal layer 3 of the wafer 13, and is provided with a flat rotatable polishing disc 4 as shown in FIG. 8, with a flat polishing pad 6 affixed to the surface thereof. Furthermore, a cooling device etc. (not shown in the figure) is provided for preventing a rise in temperature.

A pad conditioner 21 is for abrading the surface of the polishing pad 6 of the primary platen 20. As shown in FIG. 6, the abrasive dresser 15 of the present invention is rotatably attached to a tip end of a dresser arm 22 via a position adjuster 23. The pad conditioner 21 is pivoted in the direction of the arrow B–B' about a base end of the dresser arm 22. The pad conditioner 21 may also be constructed such that the dresser arm 22 does not pivot in the direction of the arrow B–B' as described above, but is moved parallel with the transverse direction.

A slurry supply nozzle 24 is for supplying a slurry of an abrasive material mixed with an acidic chemical polishing agent such as nitric acid having a high pH, to the polishing pad 6 on the primary platen 20.

A final platen 25 is a rotatable flat disc which is provided for washing away polishing agent etc. which becomes attached to the surface of the wafer 13 being processed due to polishing on the primary platen 20. A pure water supply nozzle 26 is for supplying pure water to the surface of the final platen 25.

An end station 27 is a place for receiving and temporarily storing the wafer 13 from the carrier arm 19 after being washed at the final platen 25. An unload station 28 is a place provided for mounting a wafer cassette storing wafers 13 which have completed the above processing. Here the clean station 18 and the end station 27 are provided along the conveying path of the wafer 13, from the loading station 17 to the unload station 28.

Figure 3:
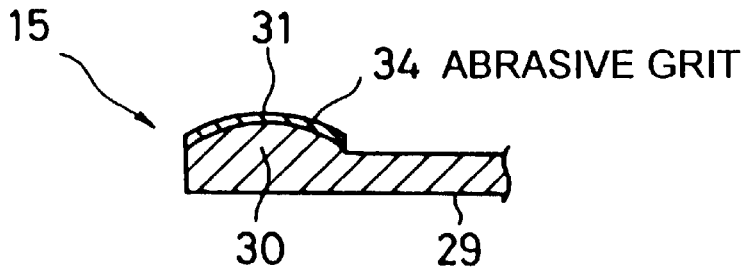
FIG. 3 is a enlarged sectional view showing a protruding portion and abrasive surface of the abrasive dresser.

Next is a description, with reference to FIG. 1 through FIG. 3, of the abrasive dresser 15 for abrading the polishing pad 6 (refer to FIG. 8) of the polishing disc 4 provided on the primary platen 20, in the CMP 16 constructed as described above. The overall construction of the abrasive dresser 15, as shown in FIG. 2, comprises for example an outer peripheral portion of a circular flat disc base member 29 protruding upward with a predetermined width as shown in FIG. 1, and an abrasive surface 31 formed by substantially uniformly distributing and affixing an abrasive grit such as diamond grit to the surface of the upward protruding portion 30.

The base member 29 is formed from a silicon, or is formed from a duracon resin such as bakelite which has excellent resistance to chemical polishing agents. Furthermore, a hole 32 of predetermined internal diameter is formed in a central portion of the base member 29. The hole 32 is to minimize strain due to overall deformation of the base member 29.

Furthermore, as shown in FIG. 2, radial grooves 33 are formed around the periphery of the abrasive surface 31 of the protruding portion 30, at a predetermined spacing. The grooves 33 are provided so that at the time of abrading the polishing pad 6 of the polishing disc 4 provided on the primary platen 20, with the abrasive dresser 15, the slurry of abrasive material mixed with the acidic chemical polishing agent also freely enters the central side from the peripheral outer side of the protruding portion 30 when supplied to the polishing pad 6 by the slurry supply nozzle 24 shown in FIG. 5. Hence the polishing by the abrasive dresser 15 can be smoothly performed.

Furthermore, with the affixing of the abrasive grit to the surface of the protruding portion 30, diamond grit or the like is substantially uniformly distributed and affixed by metal electro-deposition using a metal such as nickel, to thereby form the abrasive surface 31. Alternatively, the diamond grit or the like may be substantially uniformly distributed over and affixed to the surface of the protruding portion 30 using an adhesive having a resistance to chemical polishing agents, such as glass bond or resin bond. In this way, an abrasive surface 31 is formed on the surface of the protruding portion 30.

When the affixing of the abrasive grit to the abrasive surface 31 is performed using metal electro-deposition, the affixing of the abrasive grit can be easily and securely performed. Furthermore, when the affixing of the abrasive grit to the abrasive surface 31 is performed by bonding with a bonding agent having a resistance to the chemical polishing agent, then peeling off of abrasive grit due to the chemical polishing agent can be prevented. Moreover, when the abrasive grit is diamond grit, since diamond grit is a hard material and also resistant to the chemical polishing agent, this is ideal for abrading the polishing pad 6 of the polishing disc 4.

Furthermore, with the present invention, as shown in FIG. 3, the cross-sectional shape of the abrasive surface 31 is formed with a convex circular arc curved surface. That is to say, in FIG. 3, the cross-sectional shape of the protruding portion 30 is formed as a convex circular arc curved surface having a predetermined radius, and an abrasive grit 34 is affixed to the surface of the protruding portion 30 having the convex circular arc curved surface, using the abovementioned metal electro-deposition, or a bonding agent having resistance to the chemical polishing agent, to thereby form the abrasive surface 31. As a result, the cross-sectional shape of the abrasive surface 31 also is finished with a convex circular arc curved surface.

Figure 4:
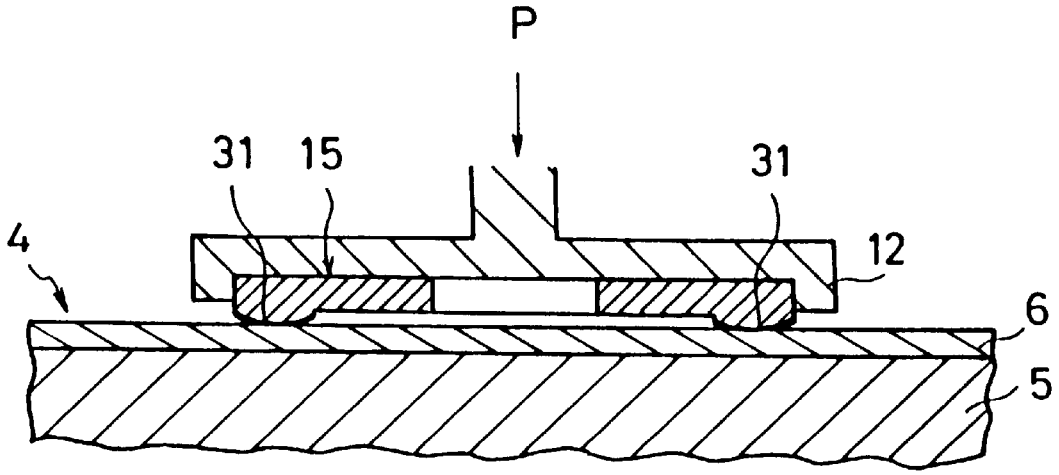
FIG. 4 is a explanatory sectional view showing a condition of use of the abrasive dresser.

In abrading the polishing pad 6 of the polishing disc 4 provided on the primary platen 20 as shown in FIG. 5 and FIG. 6 using the abrasive dresser 15 constructed in this manner, then as shown in FIG. 4, the abrasive dresser 15 is retained by a retainer 12 of the position adjuster 23 provided at the tip end of the dresser arm 22 shown in FIG. 6. Then by rotating the polishing disc 4 and contacting the abrasive surface 31 of the abrasive dresser 15 retained in the retainer 12, against the surface of the polishing pad 6 from above, the surface of the polishing pad 6 is abraded.

At this time, when an additional load is applied in the direction of the arrow P to the central portion of the retainer 12 so that the abrasive surface 31 of the abrasive dresser 15 pushes against the polishing pad 6 of the polishing disc 4 from above, then under the pressing force of the abrasive surface 31, the polishing pad 6 deforms to a slightly sunken shape due to its resilience. With the present invention, since the cross-section shape of the abrasive surface 31 is formed as a convex circular arc curved surface, then as shown in FIG. 4, at first this contacts the surface of the polishing pad 6 only at the apex portion of the circular arc curved surface. Then with the increase in the pressing force, the polishing pad 6 deforms so that the contact of the abrasive surface 31 and the polishing pad 6 deepens and the contact portion widens towards the opposite sides of the apex portion of the circular arc curved surface.

Then, with the abrasive surface 31 pressed against the surface of the polishing pad 6 under a predetermined pressing force, the surface of the polishing pad 6 deforms to a shape following the convex circular arc curved surface of the abrasive surface 31, contacting over a somewhat widened width centered on the apex of the circular arc curved surface, so that effectively a surface contact condition is obtained in the contact between the abrasive surface 31 and the polishing pad 6.

As a result of this, a configuration where the abrasive grit 34 distributed over and affixed to the abrasive surface 31 is distributed and affixed over a somewhat widened width is contacted as a surface with the polishing pad 6 to give abrasion. Hence the rapid wear of only one part can be prevented, and the life of the abrasive dresser 15 can be extended. Moreover, the replacement interval for the abrasive dresser 15 can be extended, and a large number of polishing pads 6 of the polishing disc 4 can be abraded with one abrasive dresser 15, enabling an improvement in the efficiency of abrading the polishing disc 4. Furthermore, due to the surface contact with the polishing disc, the abrading of the polishing disc can be performed well. Hence the flatness of the polishing disc itself can be improved and clogging prevented, so that the life of the polishing disc can be extended.

What is claimed is:

1. An abrasive dresser for a polishing disc of a chemical-mechanical polisher, for abrading a flat rotatable polishing disc of a chemical-mechanical polisher which supplies a chemical polishing agent to the surface of the polishing disc to polish the surface of an article on top of the polishing disc, said abrasive dresser comprising an abrasive surface formed by substantially uniformly distributing and affixing an abrasive grit to the surface of an outer peripheral portion of a flat disc shaped base member which protrudes upward over a predetermined width, wherein a sectional shape of said abrasive surface is formed as a convex circular arc curved surface.

2. An abrasive dresser for a polishing disc of a chemical-mechanical polisher according to claim 1, wherein said affixing of the abrasive grit to the abrasive surface includes affixing using metal electro-deposition.

3. An abrasive dresser for a polishing disc of a chemical-mechanical polisher according to claim 1, wherein said affixing of the abrasive grit to the abrasive surface includes bonding with a bonding agent having a resistance to the chemical polishing agent.

4. An abrasive dresser for a polishing disc of a chemical-mechanical polisher according to any one of claim 1 through claim 3, wherein said abrasive grit is diamond grit.

* * * * *